United States Patent [19]

Imamura et al.

[11] 4,284,533

[45] Aug. 18, 1981

[54] LIQUID ABRASIVE-CONTAINING CLEANSER COMPOSITION

[75] Inventors: Tetsuya Imamura, Tokyo; Ryozi Shiozaki, Funabashi, both of Japan

[73] Assignee: Kao Soap Co., Ltd., Tokyo, Japan

[21] Appl. No.: 130,765

[22] Filed: Mar. 17, 1980

Related U.S. Application Data

[63] Continuation of Ser. No. 957,164, Nov. 2, 1978, abandoned.

[30] Foreign Application Priority Data

Nov. 28, 1977 [JP] Japan ..... 52-143042

[51] Int. Cl.[3] ..... C11D 1/72; C11D 3/14

[52] U.S. Cl. ..... 252/542; 252/154; 252/155; 252/165; 252/173; 252/174.21; 252/174.23; 252/174.25; 252/548

[58] Field of Search ..... 252/140, 142, 144, 145, 252/154, 155, 159, 160, 163-165, 174.25, DIG. 2, DIG. 14, 542, 548, 173, 174.21, 174.23; 51/295

[56] References Cited

U.S. PATENT DOCUMENTS

| | | | |
|---|---|---|---|
| 3,210,285 | 10/1965 | Gangwisch | 252/155 X |
| 3,214,380 | 10/1965 | Gangwisch | 252/100 |
| 3,281,367 | 10/1966 | Jones et al. | 252/112 |
| 3,522,186 | 7/1970 | Cambre | 252/112 |
| 3,579,456 | 5/1971 | Cambre | 252/155 X |
| 3,677,954 | 7/1972 | Nakajima et al. | 252/121 |
| 3,813,349 | 5/1974 | Wolfson | 252/526 |
| 4,122,025 | 10/1978 | Kiewert et al. | 252/173 |
| 4,129,527 | 12/1978 | Clark et al. | 252/547 |

OTHER PUBLICATIONS

"Carbopol 934", B. F. Goodrich Co., Product Bulletin, (copyright 1957).

*Primary Examiner*—P. E. Willis, Jr.

*Attorney, Agent, or Firm*—Blanchard, Flynn, Thiel, Boutell & Tanis

[57] ABSTRACT

A liquid cleanser composition comprising (a) 0.1–0.6 wt. % of partially cross-linked polyacrylic acid having an average degree of polymerization of $10^3$–$10^5$ and a Brookfield yield value of higher than 100 g/sec.cm., (b) 1–10 wt. % of a hydrotrope of the formula (I) or the formula (II):

$$ROH \quad (I)$$

wherein R represents an alkyl group of 1–3 carbon atoms, or $$R'—O—(R''O)_nH \quad (II)$$

wherein R′ represents hydrogen, an alkyl group of 1–4 carbon atoms, phenyl group or benzyl group, R″ represents ethylene group, propylene group or a mixture of them, and n represents an average addition mole number and n is 1–20 when R′ is hydrogen, and n is 1–3 when R′ is a group of other than hydrogen, (c) 0.5–10 wt. % of a nonionic surfactant having an HLB of 10–17, and the remainder comprises at least one water-insoluble abrasive, water and a pH regulator effective to maintain the composition at a pH of 5–9.

11 Claims, No Drawings

LIQUID ABRASIVE-CONTAINING CLEANSER COMPOSITION

This is a continuation of application Ser. No. 957,164, filed Nov. 2, 1978, now abandoned.

BACKGROUND OF THE INVENTION

1. Field of the Invention

The present invention relates to a liquid abrasive cleanser composition. More particularly, the present invention relates to a liquid cleanser having a low viscosity which can be dispensed easily from a container and which is stable during storage for a long period of time. The cleanser comprises a partially cross-linked polyacrylic acid, a hydrotrope, a nonionic surfactant, a water-insoluble abrasive, a pH regulator and water.

2. Description of the Prior Art

Commercially available abrasive cleansers are powdery products comprising finely divided mineral substances, stones or rocks containing silica as main component, a surfactant, bleaching agent, etc. In use, the powdery abrasive cleansers have the disadvantages that when they are dispensed by shaking from a container, the cleanser powder scatters and, moreover, it is necessary to apply water to them whereby to form a suspension or dispersion. Improvements in abrasive cleansers have therefore been desired. For overcoming these disadvantages, liquid cleansers comprising cleanser particles dispersed in water have been proposed. In many of the liquid abrasive cleansers proposed heretofore, higher fatty acid alkylolamides and ethoxylated higher fatty acid alkylolamides are used as dispersion stabilizers for the cleanser particles as disclosed in U.S. Pat. No. 3,281,367 and Japanese Pat. Laid-Open No. 22908/1972. The viscosities of those dispersions are made extremely high, i.e., higher than 5000 cps, in order to maintain the dispersion stable for a long period of time. Consequently, the dispersions have poor fluidity and it is not easy to dispense same from a container. Further, the dispersion state of the cleanser particles is very unstable if the ambient temperature changes widely. Sometimes, the cleanser particles settle in the container, which is disadvantageous and, therefore, the liquid cleanser container must be shaken before use in order to make the entire cleanser composition homogeneous again.

SUMMARY OF THE INVENTION

After intensive investigations for the purpose of overcoming those defects of conventional liquid abrasive cleansers, the inventors have discovered a liquid cleanser composition having a low viscosity of less than 5000 cps which will remain stable during storage under variable ambient temperatures for a long period of time, which can be easily applied to a surface to be cleaned and which will be retained well on a vertical surface, i.e., it will not quickly drain off therefrom. The composition comprises water-insoluble abrasive particles, a partially cross-linked polyacrylic acid, a hydrotrope, a nonionic surfactant and water. The composition has a pH value regulated to be 5–9. The present invention has been attained on the basis of this finding.

DETAILED DESCRIPTION OF THE INVENTION

As the surfactant used for dispersing the water-insoluble abrasive particles, nonionic surfactants are preferred. If an anionic surfactant is used, the viscosity of the composition is reduced, the dispersion stability of the water-insoluble abrasive particles is poor and, particularly, recovery of the dispersed state after freezing is low. Still another disadvantage is that if an anionic surfactant is used, the partially cross-linked polyacrylic acid must be used in a larger amount to obtain a satisfactory viscosity, and this is economically disadvantageous.

The nonionic surfactants used in the present invention are not critically limited, except that their HLB (hydrophilic-lipophilic balance) value must be in the range of 10 to 17. The nonionic surfactants are, for example, polyoxyethylene (primary or secondary) alkyl ($C_{10}$–$C_{20}$) ethers, polyoxyethylene alkyl ($C_8$–$C_{20}$) phenyl ethers, polyoxyethylenesorbitan fatty acid esters, and polyoxypropylene-polyoxyethylene block polymers. The nonionic surfactant is incorporated in the composition in an amount of 0.5 to 10 wt. %, preferably 1 to 5 wt. %. If the nonionic surfactant is used in an amount of more than 10 wt. %, a considerable amount of the surfactant remains on the treated surface after wiping, which makes rinsing more troublesome.

The commonly used hydrotropes include urea, p-toluenesulfonates, xylenesulfonates and lower alcohols. However, urea, p-toluenesulfonates and xylenesulfonates, are not suitable for use as hydrotropes in the liquid abrasive cleanser composition, according to the invention, because the storage stability at a high temperature is poor, as evidenced by the fact that a separated layer is formed in a storage stability test at 50° C. for one hour in every case, whereby to make impossible the formation of a homogeneous dispersion. The hydrotropes used in the present invention are water-soluble materials of the following formulae (I) and (II), which have the effects of increasing the dispersion stability at a low temperature and improving recovery after freezing:

$$R—OH \quad (I)$$

wherein R is alkyl of 1 to 3 carbon atoms, and $$R'—O—(R''O)_nH \quad (II)$$

wherein R′ is hydrogen, alkyl of 1 to 4 carbon atoms, phenyl or benzyl, R″ is ethylene, propylene or mixture of them, and n is the average addition mole number, and n is 1 to 20 when R′ is hydrogen, and n is 1 to 3 when R′ is a group of other than hydrogen.

The hydrotrope is incorporated in the composition in an amount of 1 to 10 wt. %, preferably 1 to 5 wt. %. If the amount of the hydrotrope is less than 1 wt. %, the stability of the composition at a low temperature is disadvantageously low. The use of more than 10 wt. % of the hydrotrope is unnecessary and is economically unfavorable, but the stability of the composition is not reduced thereby.

As representative compounds of formulae (I) and (II), there can be mentioned ethyl alcohol, isopropyl alcohol, polypropylene glycol, diethylene glycol, ethylene glycol monoethyl ether, diethylene glycol monomethyl ether, diethylene glycol monoethyl ether, diethylene glycol monobutyl ether, triethylene glycol, oxyethylene/oxypropylene adduct of diol monomethyl ethers such as $H_3CO(CH_2CH_2O)_3(CH_2CHCH_3O)H$.

The polyacrylic acids used in the present invention are those having an average degree of polymerization of $10^3$ to $10^5$ and a Brookfield yield value, in 0.30 wt. % aqueous solution, of higher than 100 g/sec.cm. The term "Brookfield yield value" herein means a value calculated according to the following formula after determination of the viscosity of 0.30 wt. % aqueous solution of polyacrylic acid regulated to have a pH of 5 to 9 (pH regulator: triethanolamine) at 20° C.:

$$\text{Brookfield yield value} = \frac{\text{Apparent viscosity B8H viscosimeter, rotor No. 3, 0.5 rpm} - \text{Apparent viscosity B8H viscosimeter, rotor No. 3, 1 rpm}}{100}$$

The Brookfield yield value is a measure of the degree of cross-linking of the polyacrylic acid molecule. For a constant molecular weight of the polyacrylic acid molecule as the degree of cross-linking becomes higher, the Brookfield yield value becomes higher.

Partially cross-linked polyacrylic acids of various Brookfield yield values are commercially available under the trademark "Carbopol" from B. F. Goodrich Co., U.S.A. In addition, a process for preparing them is disclosed in Japanese Pat. Laid-Open No. 6789/1977. Japanese Patent Laid-Open No. 6789/1977 discloses a thickener prepared by copolymerizing acrylic acid or methacrylic acid and triallyl isocyanurate.

The partially cross-linked polyacrylic acid is incorporated in the composition in an amount of 0.1 to 0.6 wt. %, preferably 0.2 to 0.4 wt. %. When less than 0.1 wt. % of the partially cross-linked polyacrylic acid is used, the viscosity of the composition is less than 500 cps and the long time dispersion stability of the water-insoluble abrasive is poor. On the other hand, when more than 0.6 wt. % of the partially cross-linked polyacrylic acid is used, the viscosity of the composition is as high as above 5000 cps which causes problems in use.

As the water-insoluble abrasives contained in the composition of the present invention, there can be mentioned, for example, silicon dioxide, aluminum oxide, magnesium oxide, silicon carbide, boron carbide, iron oxides, titanium oxides, aluminosilicates and finely divided natural products such as powders of corundum, emery, silica, dolomite, sands and shells. Although the particle size of the abrasive may be large, abrasives having a particle diameter of 2 to 150$\mu$ are preferred. The water-insoluble abrasive is incorporated in the composition in an amount of 5 to 30 wt. %. When less than 5 wt. % of the abrasive is used, the abrasive effect is weak and, on the other hand, when more than 30 wt. % of the abrasive is used, wiping off the composition after cleansing becomes difficult. The amount of the abrasive is determined according to the type of cleaning use to be made of the composition.

The degree of dissolution of the partially cross-linked polyacrylic acid in water is variable depending on the pH of the composition and the pH exerts a great influence on the viscosity of the composition. At a pH of lower than 5 or higher than 9, the viscosity of the composition is reduced remarkably whereby to deteriorate the long term storage stability of the composition. It is considered that a reason therefor is that the molecules are shrunk in water in those pH ranges. Therefore, the pH value of the liquid cleanser composition is regulated to be in the range of 5 to 9, preferably 6 to 8. As the pH regulators, there can be mentioned ammonium hydroxide, alkanol ($C_1$–$C_3$) amines, NaOH and KOH, preferably alkanol ($C_1$–$C_3$) amines. As the alkanolamines, there can be mentioned, for example, monoethanolamine, diethanolamine and triethanolamine.

The remainder of the composition comprises water and, if necessary, small amounts of other surfactants, perfumes, pigments, dyes, sterilizers, antifungal agents, rust inhibitors, deodorants and bleaching agents.

The composition of the present invention can be prepared easily at ambient temperature without heating as described below.

The composition can be prepared by, for example, the following process. An about 2 wt. % aqueous solution of partially cross-linked polyacrylic acid is prepared. The aqueous solution was mixed with the nonionic surfactant, the hydrotrope and water with a mixer to obtain a homogeneous solution. The solution is regulated to a pH of 5 to 9 with a pH regulator. Then, the abrasive is added thereto to form the desired composition.

The liquid cleanser composition of the present invention is stable, because it does not undergo separation of the components even after storage for a long period of time. Particularly, even after repeated freezing-thawing cycles over a long period of time, the liquid composition has an excellent stability. Further, the effects of the composition on human hands and the skin are mild, because the composition is neutral. In addition, even a small amount of the composition is capable of abrading a large surface area, because the ingredients are dispersed well therein. Another advantage is that the composition can be shaken out or dispensed easily from a container owing to its low viscosity.

The following examples further illustrate the present invention. The examples do not limit the scope of the invention. Example 1.

TABLE 1

| Composition *1 | Comparative Products wt. % 1 | 2 | 3 | 4 | Product of the Invention 1 | Comparative Commercial Product *3 |
|---|---|---|---|---|---|---|
| Silicon dioxide (silica powder) | 7 | 7 | 7 | 7 | 7 | |
| Partially cross-linked polyacrylic acid *2 | | 0.3 | 0.3 | 0.3 | 0.3 | |
| Polyoxyethylene (6.5) lauryl ether (HLB12) | 3 | | 3 | | 3 | |
| Sodium lauryl sulfate | | 3 | | | | |
| Ethanol | 3 | 3 | | 3 | 3 | |
| Water | 87 | 86.7 | 89.7 | 89.7 | 86.7 | |
| Viscosity (B-type viscometer, rotor No. 3, 30 rpm). cps | separation | 600 | 1600 | 1500 | 1500 | 3000 |
| Results of Storage Test | | | | | | |
| 50° C. (one month) | X | O | O | O | O | X |
| 17° C. (one month) | X | O | O | O | O | O |
| Repeated freezing- | | | | | | |

TABLE 1-continued

| Composition *1 | Comparative Products wt. % 1 | 2 | 3 | 4 | Product of the Invention 1 | Comparative Commercial Product *3 |
|---|---|---|---|---|---|---|
| thawing (one month) | X | X | gelation | X | O | X |

*1 Regulated to pH 7 with triethanolamine
*2 Brookfield yield value: 0.3%, pH 7, 110 [g/sec · cm]
Average polymerization degree: $10^4$
*3 Sodium alkylbenzenesulfonate and ethoxylated higher fatty acid monoethanolamide were used as dispersion stabilizers
Explanatory notes:
O: No separation, equivalent to the original state.
X: Separation.

The results of experiments on the effects of the three critical components are shown in Table 1.

TABLE 2

| Composition *1 | Comparative Product 5 | Product of the Invention 2 | Comparative Product 6 | Product of the Invention 3 | Product of the Invention 4 | Comparative Product 7 | Product of the Invention 5 | Product of the Invention 6 |
|---|---|---|---|---|---|---|---|---|
| | wt. % | | | | | | | |
| Silicon dioxide (particle size 2–100μ) | 20 | 20 | 10 | 10 | 10 | 10 | | |
| Bentonite (2–150μ) | | | | | | | 10 | |
| Calcined alumina (less than 100μ) | | | | | | | | 10 |
| Partially cross-linked polyacrylic acid, polymerization degree: $10^4$, BV = 30 *2 | 0.3 | | | | | | | |
| Partially cross-linked polyacrylic acid, polymerization degree: $10^4$, BV = 100 | | 0.3 | 0.3 | 0.3 | 0.3 | 0.3 | 0.3 | 0.3 |
| Polyoxyethylene (3) lauryl ether (HLB 8) | | | 3 | | | | | |
| Polyoxyethylene (6.5) lauryl ether (HLB 12) | 3 | 3 | | 3 | | | | |
| Polyoxyethylene (13) lauryl ether (HLB 15) | | | | | 3 | | 3 | 3 |
| Polyoxyethylene (30) lauryl ether (HLB 18) | | | | | | 3 | | |
| Ethanol | 3 | 3 | 3 | 3 | 3 | 3 | 3 | 3 |
| Water | 73.7 | 73.7 | 83.7 | 83.7 | 83.7 | 83.7 | 83.7 | 83.7 |
| Storage Stability Test | | | | | | | | |
| 50° C. (one month) | X | O | X | O | O | O | O | O |
| 17° C. (one month) | O | O | O | O | O | O | O | O |
| Repeated freezing-thawing (one month) | X | O | O | O | O | O | O | O |
| Amount of abrasion *3 | 320 | 350 | 290 | 310 | 300 | 220 | — | — |

*1 Regulated to pH 7 with triethanolamine
*2 BV = Brookfield yield value
*3 Method of measuring amount of abrasion is as follows: A paint was applied in a thickness of 1 mm to an aluminum plate (5 cm length × 10 cm width) and dried. The plate was weighed and fixed on a deterging tester. The plate was cleansed with 2g of the liquid cleanser with a sponge cleaner by rubbing 100 times under a load of 1 Kg. The plate was further washed with water, dried and weighed. The abrasive effect was determined by measuring the difference in weight of the paint-applied aluminum plate before and after the treatment as follows:

$$\text{Amount of abrasion} = \frac{\text{Difference in weight of paint-applied aluminum plate when liquid cleanser is used}}{\text{Difference in weight of paint-applied aluminum plate when a standard detergent is used}} \times 100$$

Standard detergent:
Polyoxyethylene (6.5) lauryl ether 3%
Water 97%

The composition free of the partially cross-linked polyacrylic acid (Comparative product 1) did not form a stable dispersion but separation was caused. The composition containing sodium lauryl sulfate (anionic surfactant) (Comparative product 2) had a poor freezing-thawing stability and separation was caused by only one cycle of freezing-thawing. Product 1 of the present invention was stable for a long period of time. It had a suitable viscosity and, accordingly, it can be dispensed easily from a container and the ease of use thereof is far superior to that of the commercial products. Example 2.

If the Brookfield yield value of the composition is less than 100, the stability against high temperature (50° C.) and repeated freezing-thawing is poor. If a nonionic surfactant of an HLB value of less than 10 is used, the stability of the composition at a high temperature is poor and, on the other hand, if a nonionic surfactant of an HLB value of 18 or higher is used, the deterging property of the composition is poor (Table 2).

EXAMPLE 3

| Composition: | |
|---|---|
| Silicon dioxide | 7 wt. % |
| Partially cross-linked polyacrylic acid (polymerization degree: $10^4$, BV = 180) | 0.05–0.8 |
| Polyoxyethylene (6.5) lauryl ether (HLB: 12) | 3 |
| Ethanol | 3 |
| Water | to 100 |

(regulated to pH 7 with monoethanolamine)

TABLE 3

| | Amount of partially cross-linked polyacrylic acid (wt. %) | | | | |
|---|---|---|---|---|---|
| | 0.05 | 0.1 | 0.3 | 0.6 | 0.8 |
| Storage stability test at 17° C. for 1 month | X | O | O | O | O |
| Viscosity of composition cps | 200 | 600 | 1500 | 3500 | 5500 |
| Easiness of taking out from container | easy | easy | easy | easy | not easy |

If the partially cross-linked polyacrylic acid is used in an amount of less than 0.1 wt. %, the stability of the composition in the long period storage stability test is poor and, on the other hand, if its amount is more than 0.6 wt. %, the viscosity of the composition is too high and, therefore, it is not easy to dispense the composition from a container.

The influences of hydrotropes on the stability of the composition were examined (Table 4).

| Composition: | |
|---|---|
| Silicon dioxide | 15 wt. % |
| Partially cross-linked polyacrylic acid (polymerization degree: $10^4$, BV = 150) | 0.3 |
| Hydrotrope | 0 or 3 |
| Water | to 100 |

(regulated to pH 7 with triethanolamine)

TABLE 4

| | Hydrotrope | | | | |
|---|---|---|---|---|---|
| Storage Stability | Ethanol | Diethylene glycol monobutyl ether | Propylene glycol | Urea | Not Added |
| 50° C. 1 month | O | O | O | X | O |
| 17° C. 1 month | O | O | O | O | O |
| Repeated freezing-thawing cycles for one month | O | O | O | O | gelation |

When diethylene glycol monobutyl ether, propylene glycol or ethanol were used as hydrotrope, the composition was stable under all test conditions, whereas when urea was used, precipitates were formed in the storage stability test carried out at 50° C. for one month.

The embodiments of the invention in which an exclusive property or privilege is claimed are defined as follows:

1. A liquid abrasive cleanser composition consisting essentially of:

(a) 0.1 to 0.6 wt. % of cross-linked polyacrylic acid having an average degree of polymerization of $10^3$ to $10^5$ and a Brookfield yield value of at least about 100 g/sec.cm., said cross-linked polyacrylic acid having been prepared by copolymerizing acrylic acid or methacrylic acid with triallyl isocyanurate, (b) 1 to 10 wt. % of hydrotrope of formula (I) or formula (II):

$$ROH \quad (I)$$

wherein R is alkyl having 1 to 3 carbon atoms, or $$R'—O—(R''O)_nH \quad (II)$$

wherein R' is hydrogen, alkyl having 1 to 4 carbon atoms, phenyl or benzyl, R'' is ethylene, propylene or mixture thereof, and n is the average addition mole number with the provisos that n is 1 to 20 when R' is hydrogen and n is 1 to 3 when R' is a group of other than hydrogen, (c) 0.5 to 10 wt. % of nonionic synthetic organic surfactant having an HLB of 10 to 17, (d) 7 to 20 wt. % of water-insoluble abrasive having a particle size of from about 2 to about 150 microns, and the balance of the composition is essentially water and a water-soluble pH regulator in an amount effective to maintain the composition at a pH of 6 to 8.

2. A liquid abrasive cleanser composition according to claim 1 wherein the partially cross-linked polyacrylic acid has an average polymerization degree of $10^4$ and a Brookfield yield value of 100–200 g/sec.cm.

3. A liquid abrasive cleanser composition according to claim 1 or claim 2 wherein the nonionic surfactant is a condensate of ethylene oxide and a primary or secondary alcohol having an alkyl chain of 10–20 carbon atoms.

4. A liquid abrasive cleanser composition according to claim 1 containing 1 to 5 wt. % of said nonionic surfactant.

5. A liquid abrasive cleanser composition according to claim 1 wherein the hydrotrope is a compound of formula (I).

6. A liquid abrasive cleanser composition according to claim 1 wherein the hydrotrope is ethanol.

7. A liquid abrasive cleanser composition according to claim 1 wherein the pH regulator is ammonium hydroxide.

8. A liquid abrasive cleanser composition according to claim 1 wherein the pH regulator is an alkanolamine having 1 to 3 carbon atoms.

9. A liquid abrasive cleanser composition according to claim 1 wherein the water-insoluble abrasive is a member selected from the group consisting of silicon dioxide, aluminum oxide, magnesium oxide, titanium oxide, aluminosilicate, silicon carbide, iron oxides, powdery silica and powdery sands.

10. A liquid abrasive cleanser composition according to claim 1 in which the pH regulator is selected from the group consisting of ammonium hydroxide, alkanol ($C_1$–$C_3$) amines, NaOH and KOH.

11. A liquid abrasive cleanser composition according to claim 1 wherein the pH regulator is NaOH or KOH.

* * * * *